US007943082B2

(12) United States Patent
Arakane et al.

(10) Patent No.: US 7,943,082 B2
(45) Date of Patent: May 17, 2011

(54) WATER-COOLING JACKET STRUCTURE FOR INSPECTION HOLE OF FLASH FURNACE

(75) Inventors: Takayuki Arakane, Oita (JP); Yoshiaki Suzuki, Tamano (JP)

(73) Assignee: Pan Pacific Copper Co., Ltd., Oita (JP)

( * ) Notice: Subject to any disclaimer, the term of this patent is extended or adjusted under 35 U.S.C. 154(b) by 273 days.

(21) Appl. No.: 12/333,845

(22) Filed: Dec. 12, 2008

(65) Prior Publication Data

US 2009/0165684 A1 Jul. 2, 2009

(30) Foreign Application Priority Data

Dec. 28, 2007 (JP) ..... 2007-340041

(51) Int. Cl.
*C21B 7/24* (2006.01)

(52) U.S. Cl. ..... 266/100; 266/241

(58) Field of Classification Search ..... 266/100, 266/241

See application file for complete search history.

(56) References Cited

U.S. PATENT DOCUMENTS

| | | | | |
|---|---|---|---|---|
| 3,478,236 | A * | 11/1969 | Tyrrell | 310/11 |
| 4,382,585 | A * | 5/1983 | Fischer et al. | 266/190 |
| 5,441,205 | A * | 8/1995 | Kanazumi et al. | 241/41 |
| 6,257,326 | B1 * | 7/2001 | Heinrich | 165/169 |
| 2009/0085263 | A1 * | 4/2009 | Tsuchie et al. | 266/100 |

FOREIGN PATENT DOCUMENTS

| | | |
|---|---|---|
| JP | 05-180573 | 7/1993 |
| JP | 3381241 | 7/1993 |

* cited by examiner

*Primary Examiner* — Scott Kastler
(74) *Attorney, Agent, or Firm* — Leighton K. Chong

(57) ABSTRACT

A water-cooling jacket structure 10 for an inspection hole of a flash furnace 1 is arranged at the periphery of a concentrate burner 7 to inspect and clean the inside of the furnace and the concentrate burner 7, and formed in a cylindrical shape by combining a plurality of jacket plates 11, 12, 13, 14 cast internally with cooling tubes 21, 22, 23, 24 for circulating cooling-water, and configured to adjust its cooling capacity and amount of cooling-water by circulating cooling-water to a single or multiple systems of the respective cooling-water systems of each jacket 11, 12, 13, 14 depending on the heat-load of the flash furnace 1.

5 Claims, 5 Drawing Sheets

WATER-COOLING JACKET STRUCTURE FOR INSPECTION HOLE OF FLASH FURNACE

BACKGROUND OF THE INVENTION

1. Field of the Invention

The present invention relates to a water-cooling jacket structure for an inspection hole of a flash furnace, and more particularly to a water-cooling jacket structure for an inspection hole of a flash furnace arranged at the periphery of a concentrate burner on a ceiling of a reaction shaft of the flash furnace used for inspecting and cleaning the inside of the furnace and the concentrate burner.

2. Description of the Related Art

First of all, an outline of the workflow of copper smelting will be explained. Ore dug out from a mine is called "crude ore", and since it contains large amount of worthless materials (so called gangues) besides useful minerals, gangues are removed from the crude ore as tailings by a process called "concentration", and the concentrates of high-grade obtained thereby are applied to smelting. The difference in physical or physicochemical property such as density, hardness, magnetism, permittivity and wettability of minerals is utilized in the concentration processes.

Concentrates obtained by concentration are thermally dried for the purpose of reducing heat energy required in smelting processes, making it easier to handle minerals in case of supplying and transporting them to furnaces, and also avoiding decrease in responsiveness due to moisture. Drying process is implemented, for example, by a rotary drier in a similar configuration as a rotary kiln provided with a furnace formed in a slightly inclined long cylindrical shape.

Concentrates obtained are supplied to a flash furnace with oxygen enriched air or hot air of high temperature simultaneously to induce instant chemical reaction, and separated into matte and slag. The flash furnace 1 is comprised of a reaction shaft 3, a settler 4 and an uptake 5, as shown in FIG. 5, and said reaction shaft 3 is provided with 1 to 3 concentrate burners 7. The concentrates are blown into the furnace via the concentrate burners 7. The flash furnace is characterized to be lower in specific fuel consumption than other means since it utilizes heat produced by oxidation reaction of the concentrates. However, in case the heat produced by oxidation reaction is insufficient, auxiliary combustions from the concentrate burners 7 using fuel oil and such can be implemented. In the matte obtained in this process, 60~65% of copper is included. Since 1% of copper is included also in the slag, slag cleaning is conducted in a slag cleaning furnace 1*a* (not illustrated) to recover copper therein as matte to be further combined with matte obtained in the flash furnace 1 and processed in a converter. On a ceiling 3*a* of the reaction shaft 3 of the flash furnace 1, an inspection hole 9 for inspecting and cleaning the inside of the furnace and the concentrate burners is provided.

The converter is in the shape of a transversely-situated cylinder with its inner surface covered with magnesite or chrome-magnesite bricks, and configured so as to be inclined back and forth by an electric motor so that charging and discharging of materials can be conducted conveniently. A plurality of tuyeres is provided at the lower part of the sidewall of the furnace, and pressurized oxygen of about 100 kPa (1 kg/cm$^2$) in gauge pressure is blown directly into the molten matte from the tuyeres. The operation includes slag-making stages and copper-making stages conducted in batches, and in the slag-making stage, steel included in the matte is removed as slag. The slag-making stage is repeated 2 to 3 times and after a certain amount of white metal is obtained in the operation, the operation proceeds to the copper-making stage to obtain crude copper. Crude copper obtained in the operation is then processed in a smelting furnace of transversely tilted type or reverberator type to adjust S and O included in the crude copper, to be cast into anode thereafter and to obtain electrolytic copper of higher grade by processing it with electrolytic smelting.

During the operation of the flash furnace, matte-sticking 2, so-called "beko" in Japanese, gradually builds up on the inner wall of the inspection hole 9 within the furnace and the concentrate burners 7. The matte-sticking can be a major problem to hinder inspection of the inner furnace and the concentrate burners 7 as it may grow as large as to block the inspection hole as well as air outlets of the concentrate burners 7. With an increasing demand for copper, the processing amount of copper in the operation of a flash furnace is increasing and the heat-load on the furnace is getting higher than before. Therefore, an increasing amount of matte-sticking 2 is adhered to some parts of the furnace, and the furnace has to be cleaned once in about every 4 hours (6 times per day).

Further, in order to reduce heat-load, the furnace body needs to be efficiently cooled. Here, reference is made to JP Patent Registration No. 3381241 and JP Patent Publication Heisei 5-180573. These references disclose structures to cool a furnace body by disposing cooling jacket plates or cooling boxes to surround the sidewall 3*b* of a reaction shaft.

SUMMARY OF THE PRESENT INVENTION

Object of the Present Invention

However, it became evident that it is difficult to prevent adherence of matte-sticking just by installing such water-cooling structure as disclosed in the above-noted Japanese patent references to the ceiling of the flash furnace. Hence, to configure the inspection hole as a water-cooling jacket structure having a water-cooling jacket configuration was considered. At first, the water-cooling jacket structure was made as an integral structure in a cylindrical shape having water passages for circulating cooling water cast in a certain part of the configuration, but it turned out that this would not withstand the heat-load which has escalated by the increase of processing amount due to the recent growth in copper demand. In addition, such water-cooling jacket structure itself had a short life span requiring exchange once a year, which further raised a matter of increased installation cost.

Further, matte-sticking adhered to the bottom side of the inspection hole may block the inlets of air or oxygen-enriched air blown from the concentrate burners and affect airflow within the furnace, which further hinders the normal combustion operation of concentrate. Moreover, matte-sticking formed under insufficient cooling tends to be stiff and difficult to be scraped off, which made the removal process even more troublesome.

Under such circumstances, the present inventors keenly reconsidered the above matters and found out that a water passage created by casting had a high risk of leakage which led to a problem of shortening life span. They have also found that since a monolithic refractory was provided to seal a semicircular gap formed between the end of the water-cooling jacket structure of the inspection hole and the concentrate burners, cooling efficiency thereto by the water-cooling jacket structure became insufficient and made the matte-sticking difficult to remove. This further resulted in increasing the workload in the removal process for matte-sticking as well as disturbing thermal convection at the concentrate burner section, which resultingly weakened the reaction of concentrate.

Reflecting on the above circumstances, it is an object of the present invention to provide a water-cooling jacket structure of an inspection hole of a flash furnace to prevent water leakage from occurring and to contribute in a stabilized operation of the furnace.

Another object of the present invention is to provide a water-cooling jacket structure of an inspection hole of a flash furnace to facilitate removal of matte-sticking at the periphery of concentrate burners which affect the reaction at the burners greatly, and consequently contribute to reducing slag loss by stabilizing the operation and offering consistent reaction in the furnace.

Yet, another object of the present invention is to provide a water-cooling jacket structure of an inspection hole of a flash furnace having an inspection hole jacket structure with a longer life span and which contributes to reducing running cost.

Method to Achieve the Object

In order to achieve the above mentioned objects, a water-cooling jacket structure for an inspection hole of a flash furnace is installed on an inspection hole arranged at the periphery of a concentrate burner on a ceiling of a reaction shaft of a flash furnace for inspecting and cleaning the inside of said furnace and said concentrate burner, said water-cooling jacket structure being formed in a generally upright elongate shape by combining a plurality of jacket plates cast internally with cooling tubes for circulating cooling-water, allowing to adjust its cooling capacity and amount of cooling-water by circulating cooling-water to a single or multiple systems of the respective cooling-water systems of each jacket structure depending on the heat-load of said flash furnace.

A plurality of jacket plates cast internally with cooling tubes for circulating cooling-water is combined to form a hollow upright elongate shape, and observation of the inside of the furnace as well as inspection and removal of matte-sticking are conducted via its hollow center. Further, it is possible to adjust the cooling capacity by circulating cooling-water to a single or multiple systems and also possible to reduce running cost by adjusting the amount of cooling-water to be circulated.

In order to achieve the above mentioned objects, the water-cooling jacket structure for an inspection hole of a flash furnace has cooling tubes that are pipes made of copper or copper alloy and the periphery of said cooling tubes being cast with copper or copper alloy.

The jacket plates are cast with cooling tubes arranged in a desirable shape. Troubles concerning water leakage can be prevented by employing pipes instead of producing water passages for cooling-water within the structure by casting since cracks and such are less likely to be formed even when the wall thickness around the water passages became thin with the melting of the jacket plates.

In order to achieve the above mentioned objects, the water-cooling jacket structure for an inspection hole of a flash furnace is configured so that its hollow center is disposed to be inclined towards an outer cylinder of said concentrate burner while a section of said jacket structure adjacent to said outer cylinder of said burner is formed to match the curvature of the outer cylinder of said burner.

It is possible to more effectively cool the section close to the concentrate burner by shaping the section of the jacket structure adjacent to the concentrate burner to match the curvature of the outer cylinder of the burner. Furthermore, it becomes possible to inspect and clean the section closer to the concentrate burner.

In order to achieve the above mentioned objects, the water-cooling jacket structure for an inspection hole of a flash furnace has a cover member made of metal provided around said jacket plates configured in a upright elongate shape.

The metal cover member securely reinforces the upright elongate body comprised by combining a plurality of jacket plates.

In order to achieve the above mentioned objects, the water-cooling jacket structure for an inspection hole of a flash furnace has jacket plates that include right and left side plates in the shape of an approximate parallelogram, a front plate having at least the section adjacent to said outer cylinder of said concentrate burner formed to match the curvature of said outer cylinder of said burner and a back plate in the shape of a rectangle, lateral sides of each jacket plate being welded with each other to form a rectangular shape with a hollow center, said right and left side plates being provided with attachments on respective outer edges located outside the furnace to be retained to the furnace.

Effect of the Invention

According to the water-cooling jacket structure for an inspection hole of a flash furnace of the present invention, it has an effect of preventing troubles related to water leakage of the inspection hole jacket from occurring and contributes to stabilizing the operation of the flash furnace.

Further, according to the water-cooling jacket structure for an inspection hole of a flash furnace of the present invention, it has an effect of facilitating removal of matte-sticking adhered to the periphery of the concentrate burner which greatly affects the reaction at the concentrate burner, and thereby contributes to reducing slag loss by stabilizing the operation and offering consistent reaction in the flash furnace.

Moreover, according to the water-cooling jacket structure for an inspection hole of a flash furnace of the present invention, the life span of the water-cooling jacket structure is made longer to extend the cycle of exchange while cooling-water is circulated to a single or multiple systems to adjust the amount of cooling-water to be used, and thereby contributes greatly to reducing running cost.

DESCRIPTION OF THE PREFERRED EMBODIMENT OF THE INVENTION

Figure 1:
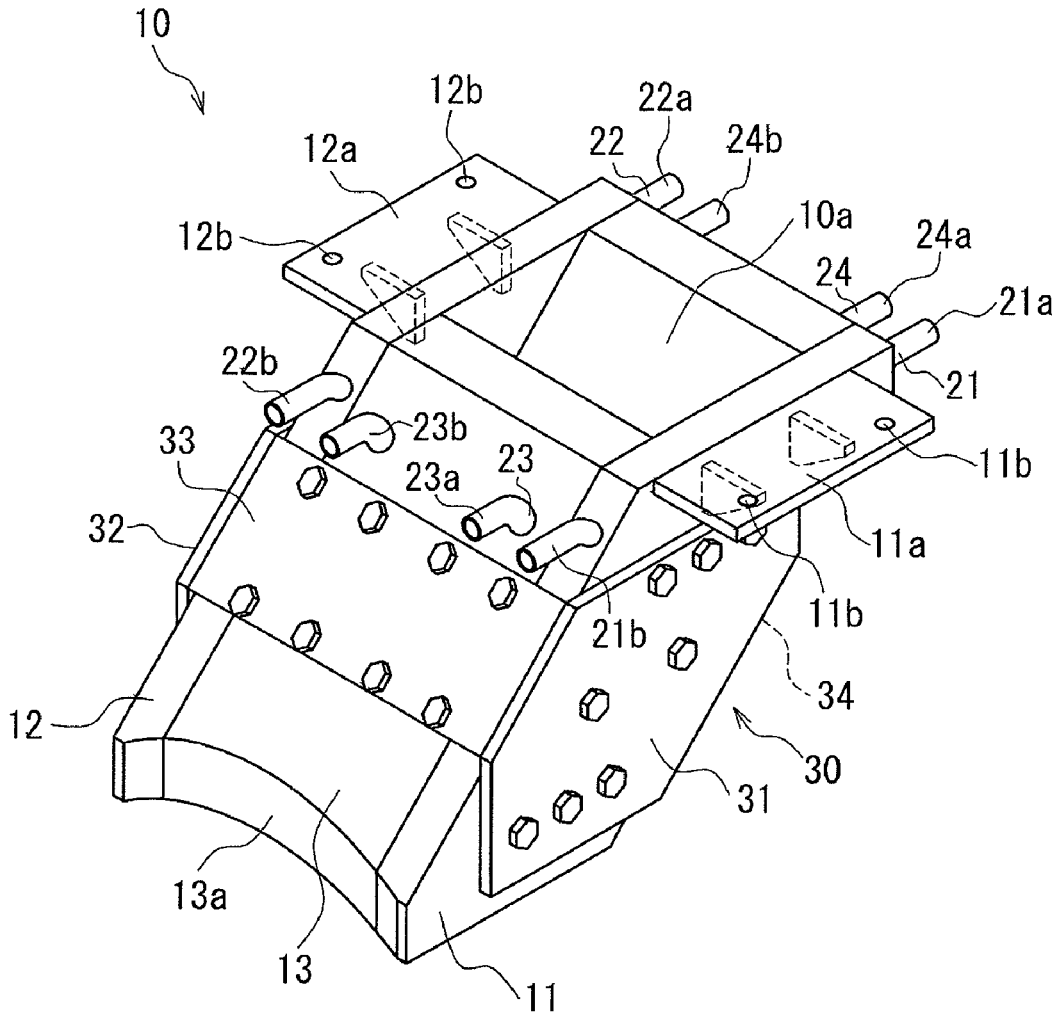
FIG. 1 is a perspective view of an embodiment of the water-cooling jacket structure for an inspection hole of a flash furnace according to the present invention.
Figure 2:
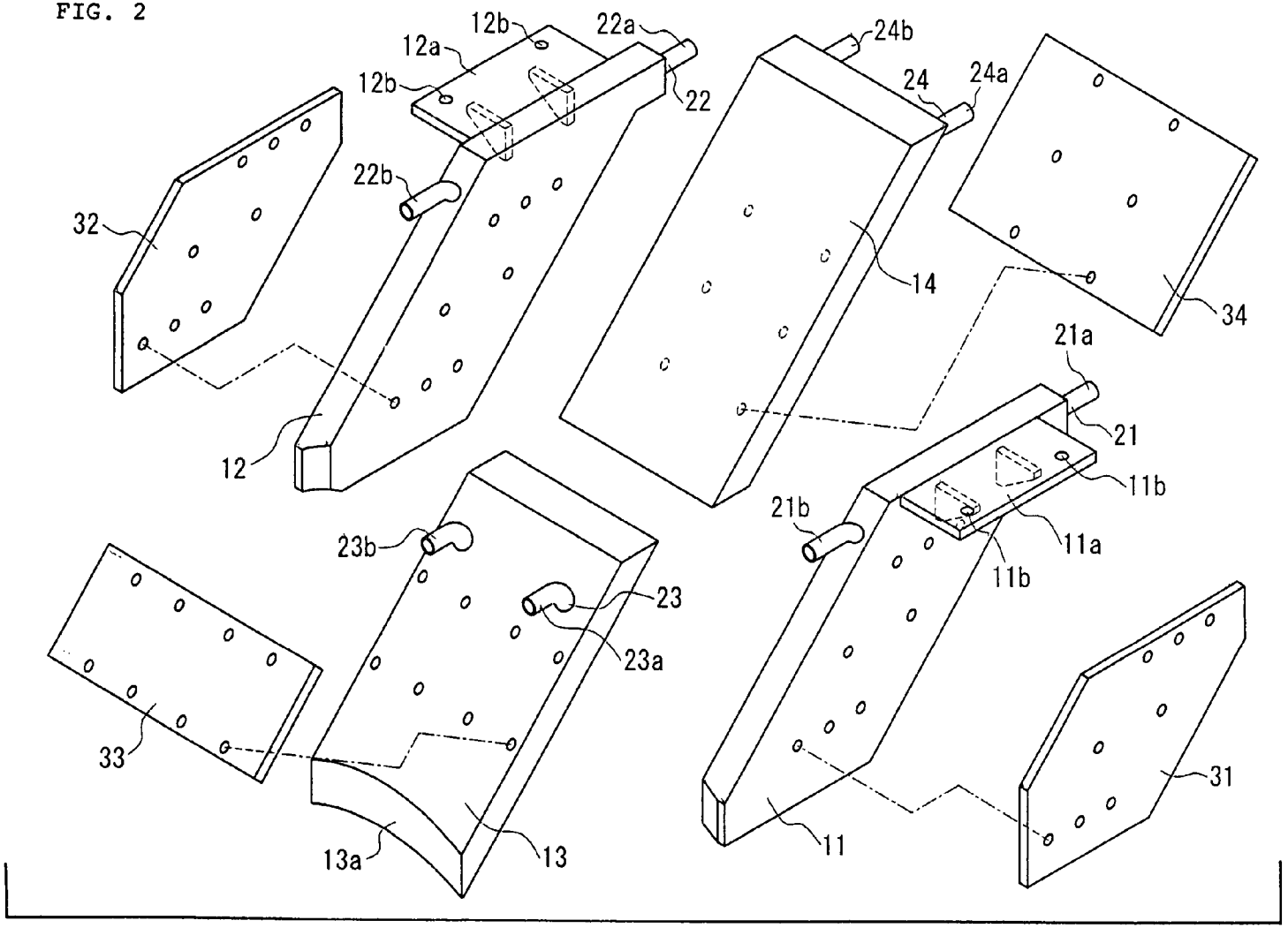
FIG. 2 is an exploded perspective view of the water-cooling jacket structure for an inspection hole of a flash furnace presented in FIG. 1.
Figure 3:
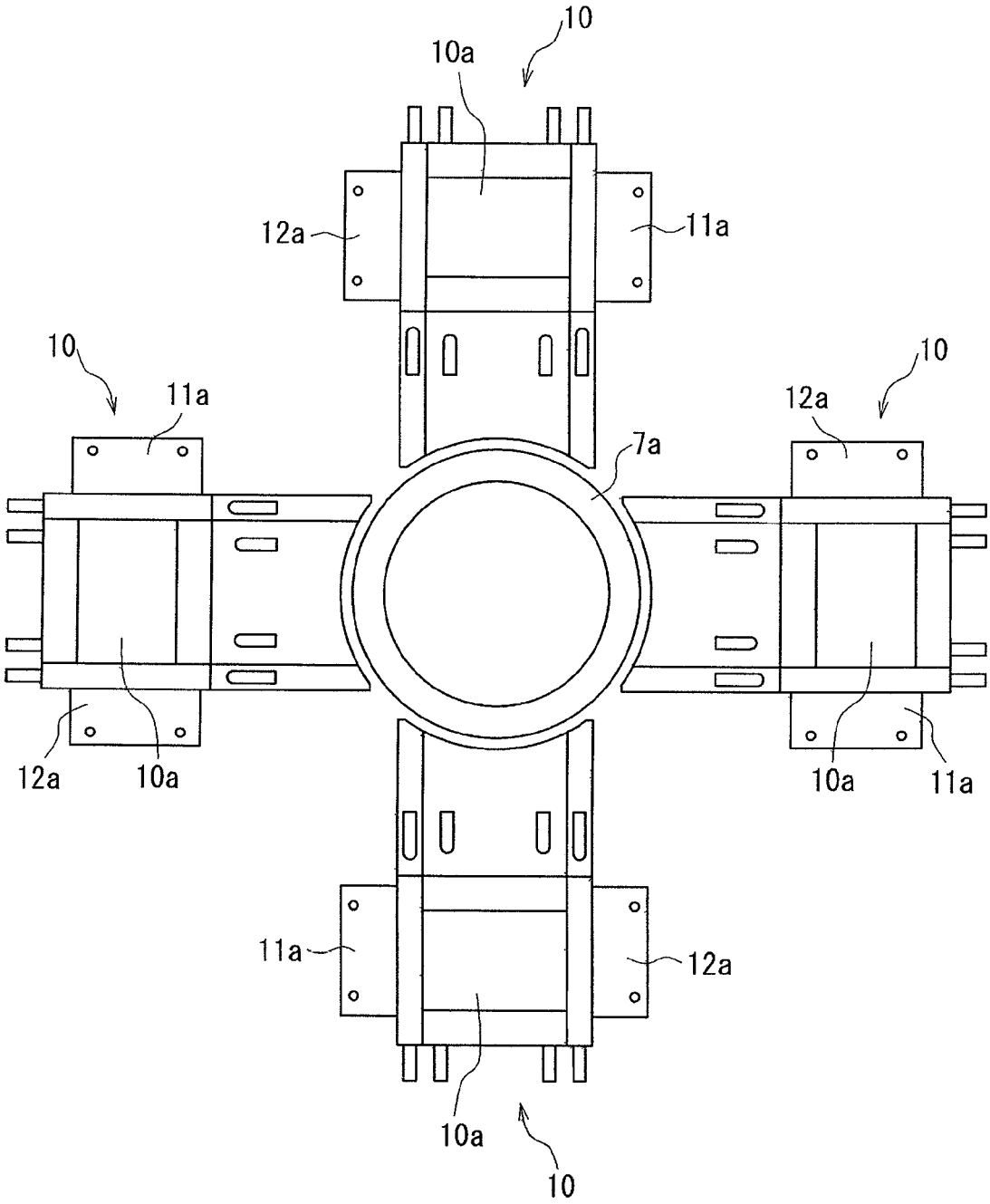
FIG. 3 is a drawing presenting the arrangement of the water-cooling jacket structure for an inspection hole is arranged.

A water-cooling jacket structure for an inspection hole of a flash furnace according to the present invention is described in detail herein below with reference to the appended drawings. In FIG. 1, a cross-sectional view of an embodiment of the water-cooling jacket structure for an inspection hole of a flash furnace according to the present invention is presented, and in FIG. 2, an exploded perspective view thereof is presented.

The water-cooling jacket structure 10 for an inspection hole of a flash furnace presented in the drawings is formed in a rectangular or generally upright elongate body with a hollow center 10*a* by combining jacket plates 11, 12, 13, 14 respectively provided with cooling tube 21, 22, 23, 24 for circulating cooling-water internally.

Figure 4:
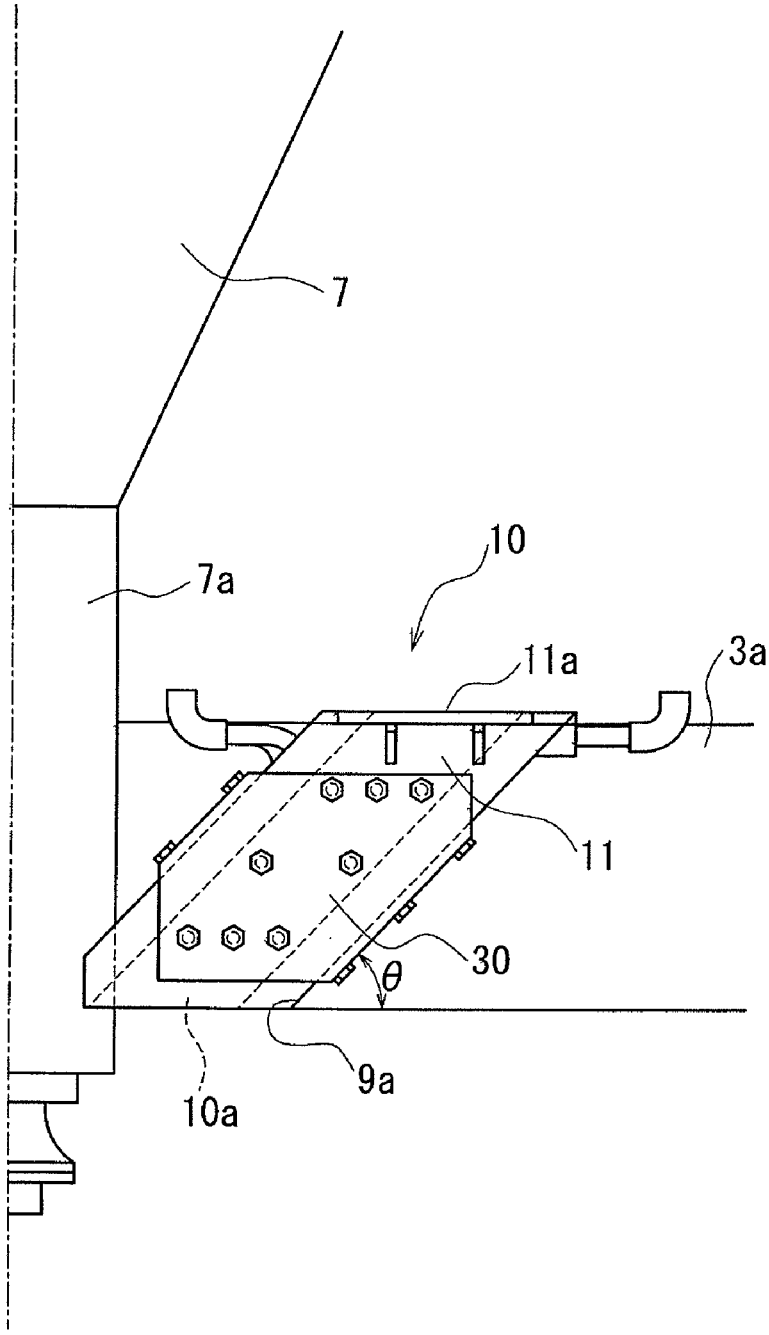
FIG. 4 is a side view presenting a state in which the water-cooling jacket structure for an inspection hole is arranged to the ceiling.
Figure 5:
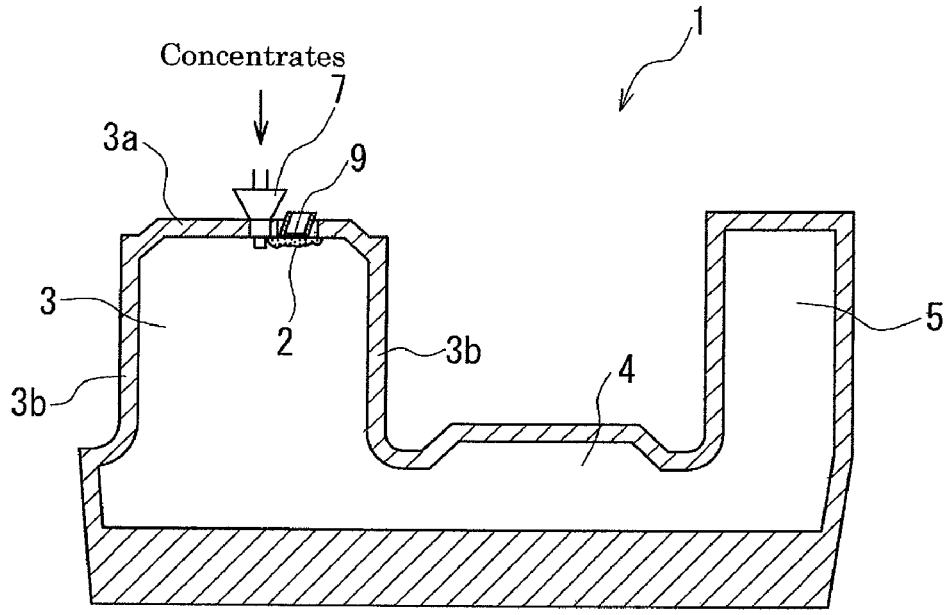
FIG. 5 is a sectional side view of a flash furnace

The respective jacket plates 11, 12, 13, 14 are formed as right jacket plate 11, left jacket plate 12, front jacket plate 13 and back jacket plate 14, and jacket plates 11, 12 at the right and left are formed symmetric to each other. The cooling tube 21 is provided internally within the right jacket plate 11 and one end thereof protrudes externally from the upper section of a lateral edge of the jacket plate 11 adjacent to the front jacket plate 13 as an inlet 21*b*, and the opposite end of the cooling tube 21 protrudes externally from the upper section of a lateral edge of the jacket plate 11 adjacent to the back jacket plate 14 as an outlet 21*a*. The right jacket plate 11 is formed in the shape of an approximate parallelogram (at an upright inclined angle) in its planar figure, and it is configured so that the hollow center 10*a* formed by combining the jacket plates 11, 12, 13, 14 is arranged to be inclined towards an outer cylinder 7*a* of a concentrate burner 7 (refer to FIG. 4). In the present embodiment, the actual shape of the right jacket plate 11 is pentagonal since the section close to the outer cylinder 7*a* (lower left corner of the right jacket plate 11) is chopped off, but assuming it is a parallelogram, it is formed so that the angle of inclination θ of oblique sides to the horizontal surface of a ceiling 3*a* is 45° as indicated in FIG. 4. The angle of inclination θ is not limited to above and it can be any angle smaller than 90°, preferably in the range of 30° to 60°.

The right jacket plate 11 is made by casting copper or copper alloy with the cooling tube 21 cast internally. Metal material used for casting can be any metal with a high heat conductivity suitable for molding, and it is not to be limited to copper and copper alloy. The cooling tube 21 is made of pipe member of copper or copper alloy, and formed in a crooked shape so that the cooling tube 21 is positioned close as possible to the outer cylinder 7*a* of the concentrate burner 7 when the water-cooling jacket structure 10 is installed on an attachment opening 9*a* (refer to FIG. 4) provided to the ceiling 3*a*. It is preferable that at least the periphery of the cooling tube 21 is cast with copper or copper alloy.

On the surface of the upper end of the right jacket plate 11, an attachment 11*a* for retaining the water-cooling jacket structure 10 to the ceiling 3*a* of a reaction shaft 3 is provided. The attachment 11*a* is made of iron steel plate, copper or copper alloy in a planar shape with through holes 11*b*, 11*b* perforated on the surface to piercing in and retaining fastening members such as bolts. Configuration of the left jacket plate 12 is similar to the right jacket plate 11 being provided with the cooling tube 22 with an inlet 22*b* and outlet 22*a* for circulating cooling-water internally as well as an attachment 12*a* with through-holes 21*b*, 12*b*, and hence the detailed explanation thereof will be omitted. However, it is noted that the left jacket plate 12 is formed symmetrical to the right jacket plate 11.

Configuration of the front jacket plate 13 is similar to that of the right and left jacket plates in regard to having a jacket structure provided internally with a cooling tube 23 with an inlet 23*b* and outlet 23*a* of cooling-water. However, unlike the right and left jacket plates 11, 12, the front jacket plate 13 is configured in an approximate rectangle in its planar figure with its end part 13*a* adjacent to the outer cylinder 7*a* of the concentrate burner 7 formed to match the curvature of the outer cylinder of the burner. More precisely, the end part 13*a* is formed in a rounded surface of arc-shape to be disposed evenly apart from the outer circumferential surface of the tubular outer cylinder. By such configuration, cooling effect on the outer cylinder 7*a* of the concentrate burner 7 is enhanced and thereby effectively reduces the temperature rise of the concentrate burner 7.

Configuration of the back jacket plate 14 is similar to that of the aforementioned front jacket plate 13 in regard to having a jacket structure provided internally with a cooling tube 24 with an inlet 24*b* and outlet 24*a* of cooling-water. However, unlike the front jacket plate 13 with its end part formed in a rounded surface, the end part of the back jacket plate 14 adjacent to the outer cylinder 7*a* of the concentrate burner 7 is configured in a linear surface so that the plate has a rectangular planar figure. However, it is possible to configure the end part of the back jacket plate 14 in a rounded surface as in the front jacket plate 13 to be disposed closer to the outer cylinder 7*a* of the concentrate burner 7.

By bonding lateral sides of the aforementioned 4 jacket plates 11, 12, 13, 14 for example by welding, a hollow center 10*a* to be used as an inspection hole is formed (refer to FIG. 1). In the present embodiment, a cover member 30 made of metal is provided around the jacket plates 11, 12, 13, 14 configured in a generally upright elongate shape. The cover plate is comprised by a right plate member 31, a left plate member 32, a front plate member 33 and a back plate member 34 made of steel plate disposed around the jacket plates 11, 12, 13, 14 and formed by bonding lateral sides of the plate members by welding and such. Strength of the water-cooling jacket structure 10 for an inspection hole of a flash furnace is reinforced by providing the cover member 30.

Next, use of the aforementioned water-cooling jacket structure 10 for an inspection hole of a flash furnace is explained. First of all, the water-cooling jacket structure 10 for an inspection hole of a flash furnace is installed on the attachment opening 9*a* provided to the ceiling 3*a* of the reaction shaft 3. The attachment opening 9*a* is formed in accordance with the shape of the water-cooling jacket structure 10, in other words formed to be inclined towards the outer cylinder 7*a* of the concentrate burner 7 from the ceiling 3*a*, and the water-cooling jacket structure 10 is installed on this attachment opening 9*a*. The water-cooling jacket structure 10 is arranged in 4 positions at every 90° surrounding the outer cylinder 7*a* of the concentrate burner 7. The arrangement of the water-cooling jacket structure 10 is not limited to 4 positions as above, and can be arranged for example in 3 positions at every 120° or 5 positions at every 72°, but since the length of the end part 13*a* of the front jacket plate 13 in the present embodiment is designed to be little less then one-fourth of the circumference of the outer cylinder 7*a* of the concentrate burner 7, it would be possible to cool the outer cylinder 7*a* efficiently by arranging them in 4 positions at every 90°.

The water-cooling jacket structure 10 for an inspection hole of a flash furnace installed on the attachment opening 9*a* is fixed firmly to the reaction shaft 3 by retaining the attachments 11*a*, 12*a* to the predetermined sections of the ceiling 3*a* of the reaction shaft 3 by fastening members such as bolts. Here, since the end part 13*a* of the front jacket plate 13 is formed in a rounded surface, it is disposed evenly apart from the surface of the outer cylinder 7*a* of the concentrate burner 7. In the present embodiment, the distance of the end part 13*a* from the surface of the outer cylinder 7*a* is designed to be about 30 mm. After arranging the water-cooling jacket structures 10 respectively at 4 positions around the outer cylinder

7*a*, supply pipes (not illustrated) for supplying cooling-water are connected respectively to the inlets 21*b*, 22*b*, 23*b*, 24*b* while drain pipes (not illustrated) are connected respectively to the outlets 21*a*, 22*a*, 23*a*, 24*a*. Since the cooling-water is supplied and drained independently to each cooling tubes 21, 22, 23, 24, it becomes possible to adjust the cooling capacity by circulating cooling-water to either a single or multiple systems. Additionally, it is possible to reduce running cost by appropriately adjusting the amount of cooling-water to be circulated.

Through the hollow center 10*a* of the water-cooling jacket structure 10 arranged as above, the condition of concentrate at the end of the concentrate burner 7 as well as the air outlet can be inspected and used for things like cleaning, for example scraping off matte-sticking adhered to the bottom side of the water-cooling jacket structure 10 for inspection hole by a lance and such may be conducted. The hollow center 10*a* can be provided with a lid member (not illustrated) for closing the hollow space, and during the operation, the hollow is securely blocked by the lid member (not illustrated) to prevent the exhaust gas from leaking outside the furnace.

Embodiment

The above explained water-cooling jacket structure 10 for an inspection hole was installed on a flash furnace and an operation was conducted. While an integrally structured water-cooling jacket had a life span of less than a year, the water-cooling jacket structure 10 as explained above had a life span of more than 2 years by the enhanced cooling effect, and contributed to a stable operation of the flash furnace. Processing amount of copper ore is showing an increase recently compared to a few years ago, and heat-load has increased by about 1.4 times, but nevertheless the present water-cooling jacket structure 10 demonstrated sufficient cooling capacity.

Since it became possible to evenly cool the periphery of the semi-circular outer cylinder 7*a* of the concentrate burner 7 with the above explained water-cooling jacket structure 10, the amount of matte-sticking is reduced while the removal thereof is facilitated, allowing the matte-sticking to be removed sufficiently. As heat environment as well as reactivity within the furnace is improved by the removal of matte-sticking, the structure contributed greatly to the stability of the operation.

Although a preferred embodiment of the present invention is explained hereinabove, the present invention is not to be limited to the particular embodiment as mentioned and wide range of modifications and variations are possible within the scope of invention limited by the appended claims.

LISTING OF PARTS ILLUSTRATED IN THE DRAWINGS

1 flash furnace
2 matte-sticking
3 reaction shaft
3*a* ceiling
3*b* sidewall
4 settler
5 uptake
7 concentrate burner
9 inspection hole
9*a* attachment opening
10 water-cooling jacket structure for inspection hole
11 right jacket plate
11*a* attachment
11*b* through-hole
12 left jacket plate
12*a* attachment
12*b* through-hole
13 front jacket plate
13*a* end part
14 back jacket plate
21 cooling tube
22 cooling tube
23 cooling tube
24 cooling tube
21*a* outlet
22*a* outlet
23*a* outlet
24*a* outlet
21*b* inlet
22*b* inlet
23*b* inlet
24*b* inlet
30 cover member
31 right plate
32 left plate
33 front plate
34 back plate

What is claimed is:

1. A water-cooling jacket structure for an inspection hole of a flash furnace arranged at the periphery of a vertically arranged concentrate burner extending vertically from en a ceiling of a reaction shaft of a flash furnace for inspecting and cleaning the inside of said furnace and said concentrate burner, said water-cooling jacket structure being formed in a upright elongate shape with a hollow center formed by combining a plurality of jacket plates joined together around the hollow center, said jacket structure having a lower part disposed over the inspection hole at the periphery of the concentrate burner extending from the ceiling of the reaction shaft of the flash furnace, and an upper part extending at an inclined angle from the inspection hole so as to be inclined away from the vertically arranged concentrate burner, wherein said plurality of jacket plates are cast internally with cooling tubes for circulating cooling-water, the cooling tubes allowing to adjust cooling capacity and amount of cooling-water by circulating cooling-water to a single or multiple cooling tubes of the respective cooling-water systems of each jacket structure depending on the heat-load of said flash furnace, and wherein a front jacket plate of said plurality of jacket plates facing the concentrate burner has a section of a lower end part formed to match the periphery of the vertically arranged concentrate burner so that it can be positioned in abutting contact therewith and allow the cooling tubes of the front jacket plate to provide a cooling effect to its area of contact with the concentrate burner and thereby effectively reduce a temperature rise of the concentrate burner.

2. The water-cooling jacket structure for an inspection hole of a flash furnace according to claim 1, wherein said cooling tubes are pipes made of copper or copper alloy and periphery of said cooling tubes being cast with copper or copper alloy.

3. The water-cooling jacket structure of an inspection hole of a flash furnace according to claim 1, wherein a section of the lower end part of the front jacket plate of said jacket structure is formed with a curvature to match a periphery of the concentrate burner.

4. The water-cooling jacket structure for an inspection hole of a flash furnace according to claim 1, wherein a cover member made of metal is provided around said jacket plates configured in a upright elongate shape.

5. The water-cooling jacket structure for inspection hole of a flash furnace according to claim 3, wherein said jacket plates include right and left side plates in the shape of an approximate parallelogram, a front plate having at least the section formed to match the curvature of the periphery of said concentrate burner and a back plate in the shape of a rectangle, lateral sides of each jacket plate being welded with each other to form a rectangular cylinder with a hollow center, said right and left side plates being provided with attachments on respective outer edges located outside the furnace to be retained to the furnace.

* * * * *